US009666178B2

(12) United States Patent
Loubiere et al.

(10) Patent No.: US 9,666,178 B2
(45) Date of Patent: May 30, 2017

(54) DEVICE FOR AIDING COMMUNICATION IN THE AERONAUTICAL DOMAIN

(71) Applicant: AIRBUS (SAS), Toulouse (FR)

(72) Inventors: Vincent Loubiere, Toulouse (FR); Netra Gowda, Toulouse (FR)

(73) Assignee: Airbus S.A.S., Blagnac (FR)

( * ) Notice: Subject to any disclaimer, the term of this patent is extended or adjusted under 35 U.S.C. 154(b) by 128 days.

(21) Appl. No.: 13/915,247

(22) Filed: Jun. 11, 2013

(65) Prior Publication Data

US 2013/0346081 A1 Dec. 26, 2013

(30) Foreign Application Priority Data

Jun. 11, 2012 (FR) ..... 12 55418

(51) Int. Cl.
*G10L 13/00* (2006.01)
*G08G 5/00* (2006.01)

(52) U.S. Cl.
CPC ..... *G10L 13/00* (2013.01); *G08G 5/0013* (2013.01); *G08G 5/0021* (2013.01)

(58) Field of Classification Search
CPC ..... G10L 13/00; G08G 5/0013; G08G 5/0021
USPC ..... 704/200, 201, 206, 210, 211, 215, 227, 704/228, 230, 231, 235, 239, 240, 241, 704/247, 248, 249, 250, 251, 252, 253, 704/255, 256, 260
See application file for complete search history.

(56) References Cited

U.S. PATENT DOCUMENTS 6,356,209 B1 3/2002 Mitchell et al.
7,809,405 B1 10/2010 Rand et al.
2002/0049589 A1* 4/2002 Poirier ..... G10L 15/34 704/235
2008/0045198 A1* 2/2008 Bhogal ..... G08G 5/0013 455/414.4
2009/0037179 A1* 2/2009 Liu ..... G10L 13/033 704/260
2009/0290698 A1* 11/2009 Lundgren ..... H04M 3/42034 379/142.04
2010/0031304 A1* 2/2010 Ariyoshi ..... G11B 27/10 725/119
2010/0070263 A1* 3/2010 Goto ..... G06F 17/30746 704/8
2011/0301842 A1* 12/2011 Krupansky ..... G01C 23/00 701/411
2013/0093612 A1* 4/2013 Pschierer ..... G08G 5/0013 342/36

FOREIGN PATENT DOCUMENTS

FR 2 773 414 7/1999

OTHER PUBLICATIONS

Search Report for FR 12 55418 dated Feb. 28, 2013.

* cited by examiner

*Primary Examiner* — Huyen Vo
*Assistant Examiner* — Rodrigo Chavez
(74) *Attorney, Agent, or Firm* — Nixon & Vanderhye P.C.

(57) ABSTRACT

A device for aiding communication in the aeronautical domain, wherein the device includes a transceiver and data processor assembly that records audio messages corresponding to all the incoming and outgoing audio communications, transcribes the messages, in real time, into textual messages, displays the textual messages, and enables an audio play back of the audio messages.

18 Claims, 3 Drawing Sheets

| S | M | T | Z |
|---|---|---|---|
| ATC | M1 | T1 | Z1 |
| P1 | M2 | T2 | Z2 |
| P2 | M3 | T3 | Z3 |
| ATC | M4 | T4 | Z4 |

17

DEVICE FOR AIDING COMMUNICATION IN THE AERONAUTICAL DOMAIN

This application claims priority to FR 12 55418 filed 11 Jun. 2012, the entire contents of which is hereby incorporated by reference.

BACKGROUND OF THE INVENTION

The present invention relates to a device for aiding communication in the aeronautical domain, in particular for an aircraft and in particular for a transport airplane, as well as a communication system comprising a plurality of devices of this type which are connected together by radio link.

Such a communication device is intended, more particularly although not exclusively, for the audio communications (of ground-air type or of air-air type) of the flight deck of an aircraft. Such an audio communication device comprises in particular:

at least one microphone;

at least one loudspeaker; and means for processing and transmitting data relating to an audio communication, which are connected to said microphone and to said loudspeaker and which are able to emit outgoing communications and to receive incoming communications.

More precisely, the present invention relates to the audio communication between a pilot of an aircraft, in particular of a transport airplane, and the Air Traffic Control (ATC), or between the pilots of two aircraft, and its object is to facilitate their exchanges and mutual understanding.

It is known that, during a flight, the pilots of an aircraft often have to carry out numerous tasks in parallel, thereby giving rise to a significant workload. Audio communication is one of these tasks. It is therefore generally carried out with the air traffic control or with surrounding aircraft.

Audio communication is, in general, relatively intense in the most critical phases, such as approach and takeoff, for which the traffic is denser than during cruising flight and the number of tasks to be carried out in parallel is high. Furthermore, although English is the language commonly used in all airports and on all airplanes, the level of verbal expression and verbal understanding of English, as well as accents, vary greatly.

All these factors can lead to misunderstandings during an audio communication, which may give rise to delays or be the origin of more significant problems.

SUMMARY OF THE INVENTION

The technology herein relates to a device for aiding communication in the aeronautical domain, in particular on an aircraft, which makes it possible to remedy the aforementioned drawbacks.

For this purpose, according to an example embodiment of the invention, said device for aiding communication, of the type comprising:

at least one microphone;

at least one loudspeaker; and means for processing and transmitting data relating to an audio communication, which are connected to said microphone and to said loudspeaker and which are able to emit outgoing communications and to receive incoming communications, is noteworthy in that it comprises moreover:

recording means for recording audio messages corresponding to all the incoming and outgoing audio communications, transmitted by said means for processing and transmitting data;

transcription means for transcribing, in real time, each of said audio messages into a textual message; and display means for displaying, on at least one screen, each textual message generated by said transcription means, while indicating moreover the source at the origin of this message.

Thus, by virtue of the invention, each communicated audio message is transcribed into a textual message which is displayed.

Consequently, a user of the device in accordance with the example embodiment of the invention, in particular a pilot of an aircraft, has at his disposal a real-time transcription of all the audio communications carried out. He is thus able to access (by reading) each message which has been communicated previously by voice. This allows him in particular to read a message that he did not properly understand verbally, whatever the reason (imperfect understanding of English, accent difficult to understand or sound transmission problem). This reading is facilitated by adjoining the source (pilot, air traffic control, etc.) to the textual message displayed.

This transcription also allows pilots, during a critical situation, in particular when several tasks have to be carried out in parallel, to implement first the tasks that they judge to be of priority, paying lesser attention to the information communicated by radio (if the latter information is not judged to be of priority), and to take cognizance and to process this information subsequently.

Moreover, in a preferred embodiment, the device for aiding communication in accordance with the invention comprises moreover:

playback means which are able to carry out audio playback of any recorded audio message; and activation means which are able to be controlled by an operator to identify and trigger the playback by the playback means of a recorded audio message.

This preferred embodiment allows a user of the device to listen to a message again instead of (or in addition to) reading it.

In a particular variant embodiment, said activation means comprise, for each textual message displayed on the screen, an associated sensitive area which is displayed jointly with the textual message with which it is associated, and which is able to be activated so as to trigger the playback of the audio message corresponding to said textual message.

Furthermore, advantageously, the device in accordance with the invention also comprises:

means allowing an operator to copy at least part of a displayed textual message, and in particular the value of a parameter, and to transmit it to a system of the aircraft, thereby avoiding the need for the pilot in the case of a parameter to enter its value and reducing the workload and the risks of error; and/or means for determining the time of emission of each audio message, this emission time being displayed by said display means on said screen jointly with the textual message with which it is associated.

Furthermore, in a particular embodiment, said device for aiding communication comprises, moreover, means making it possible to access an automatic terminal information service, of ATIS ("Automatic Terminal Information Service") type. In this embodiment, the user (pilot) can launch the recovery of the ATIS message by the aid device. The device, in an autonomous manner and as a background task, will record the ATIS message. The recording is processed by the device so as to reorder the audio message, and produce the transcription. Once the processing is complete, a sound signal indicates the end of the operation to the user, and the whole of the audio and textual message is placed at the disposal of the user, subsequent to a request through the interface displayed on the screen.

Furthermore, advantageously, said device can comprise one or more of the following characteristics:

said screen of the display means represents a dedicated single graphical interface;

said device comprises means configured to extract particular data from an audio or textual message, and means configured to use the data thus extracted, in the manner specified hereinbelow;

said device comprises means configured to inter-compare at least two messages arising from one and the same source, respectively at different moments, and to highlight differences, if any, between these two messages;

said device comprises moreover a voice recognition unit, which is configured to receive a request for information of voice type and to search a textual message for the requested information, the latter thereafter being highlighted on the screen; and said voice recognition unit comprises a voice training unit.

Within the framework of the present invention, the device for aiding communication in accordance with the invention can:

be mounted as a permanent fixture on an aircraft; or be integrated, at least in part, into a means of open world type which is able to be connected to at least one system of an aircraft, in particular in a standard laptop computer or a standard electronic tablet of a pilot comprising in particular instructions; or else be installed on the ground in an air traffic control post.

Consequently, when it is envisaged on an aircraft, in particular on a transport airplane, said device can, either be integrated into an avionics system, or form part of a system of open world type, such as a laptop computer for example or any standard portable computing means.

The technology herein also relates to a system for aiding communication in respect of audio communications in the aeronautical domain, comprising a plurality of communication units which are envisaged at different posts (or locations) (air traffic control on the ground, aircraft) and which are able to exchange messages between themselves, via for example radio waves or any other existing solution.

According to the invention, this system is noteworthy in that at least one of said communication units is such as the aforementioned device in accordance with the invention. Within the framework of the present invention, it is conceivable that the assembly of the units of the system correspond to a device in accordance with the invention, or just a part of them.

A device exhibiting the characteristics in accordance with the invention is therefore able to communicate with another device exhibiting these characteristics and/or with a standard device (or communication unit).

The technology herein relates, furthermore, to an aircraft and in particular a transport airplane, which is equipped with a communication device such as aforementioned.

BRIEF DESCRIPTION OF THE DRAWINGS

The figures of the appended drawing will elucidate the manner in which the invention may be embodied. In these figures, identical references designate similar elements.

DESCRIPTION OF THE PREFERRED EMBODIMENTS

Figure 1:
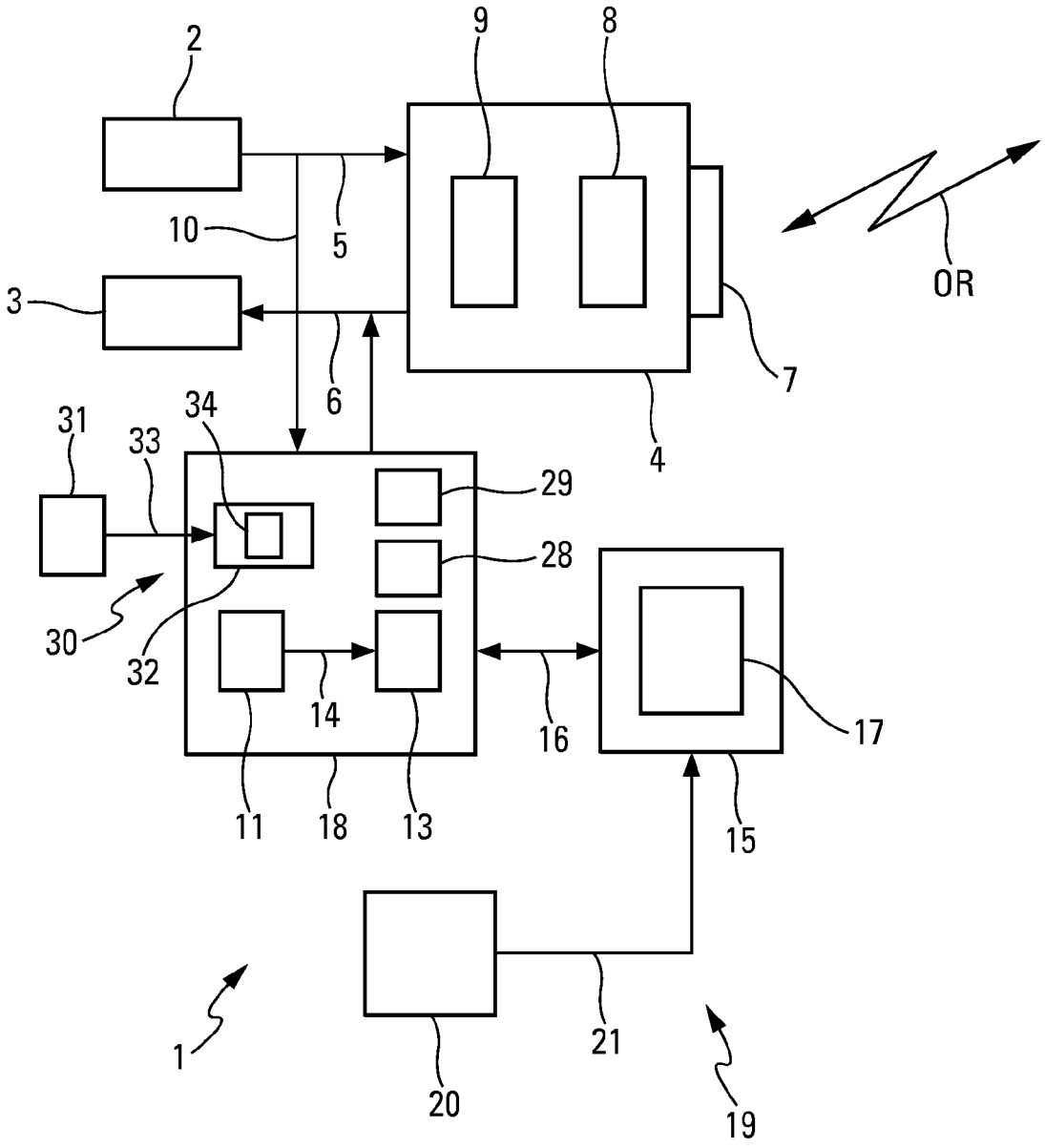
FIG. 1 is the schematic diagram of an exemplary communication device in accordance with the invention.

The device for aiding communication 1 in accordance with the invention and represented schematically in FIG. 1 is intended for the audio communications of ground-air type and/or of air-air type, in particular on the basis of the flight deck of an aircraft (not represented), in particular of a transport airplane.

In a standard manner, such a device 1 which may be onboard an aircraft, comprises in particular:

at least one microphone 2;

at least one loudspeaker 3; and standard means 4 for processing and transmitting data relating to an audio communication, which are connected by way of links 5 and 6 respectively to said microphone 2 and to said loudspeaker 3 and which are able to emit outgoing communications (out of the post (aircraft, etc.) where the device 1 is installed), and to receive incoming communications (from outside), in the form of radio waves OR.

These means 4 comprise, in a standard manner, in particular the following means:

antennas 7 for receiving and emitting messages in the form of radio waves OR;

means 8 for receiving and transmitting the messages which are connected to said antennas 7; and means 9 for processing the messages.

Moreover, said microphone 2 and said loudspeaker 3 can be mounted on a helmet, in particular of a pilot, and be connected by a cable (integrating the links 5 and 6) to said means 4.

This device 1 is therefore a radiocommunication device (using radio waves OR for communication), and the aforementioned standard means are well known and are not described further in the following description.

Figures 2, 4:
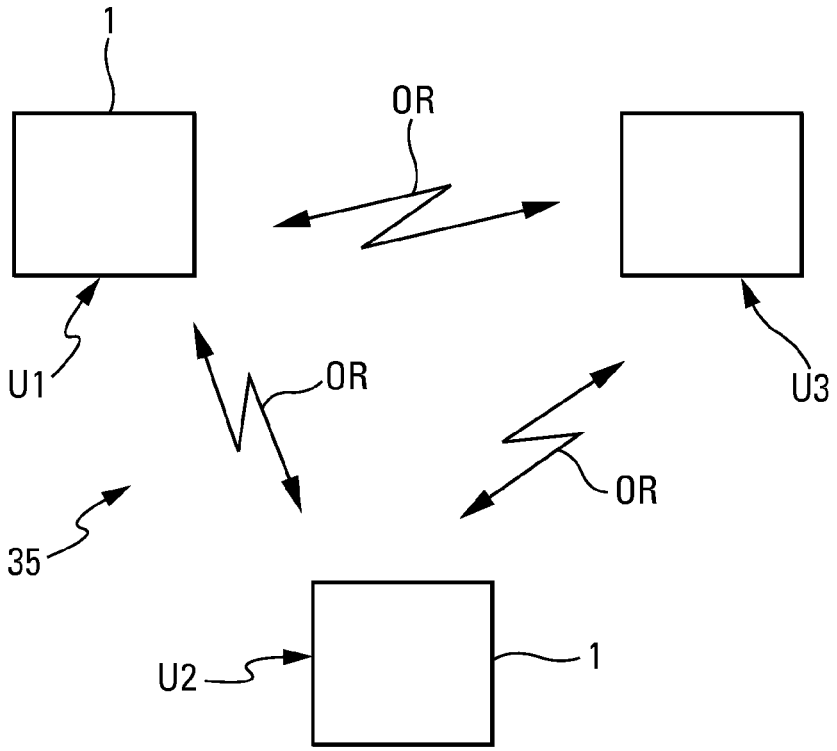
FIG. 2 schematically shows an exemplary display illustrating the invention.
FIG. 4 is the schematic diagram of an exemplary communication system in accordance with the invention.

According to the invention, said device 1 comprises moreover:

recording means 11 which record audio messages corresponding to all the incoming and outgoing audio communications, which are transmitted by said means 4 for processing and transmitting data;

standard transcription means 13, which are connected by way of a link 14 to the means 11 and which are formed so as to transcribe, in real time, in a standard manner, each of said audio messages into a corresponding textual message; and display means 15 which are connected by way of a link 16 to the transcription means 13 and which are formed so as to display, on at least one screen 17, each textual message (M1, M2, M3, M4, etc.) generated by said transcription means 13, while indicating moreover the source (air traffic control ATC, pilot P1 of a first aircraft, pilot P2 of a second aircraft, etc.) at the origin of this message, as represented by way of illustration in FIG. 2.

Preferably, said means 11 and 13 form part of an assembly 18 which is for example connected by way of links 10 and 12 respectively to said links 5 and 6.

Thus, by virtue of the invention, each communicated audio message is transcribed into a textual message which is displayed.

Consequently, a user of the device 1 in accordance with the invention, in particular a pilot of an aircraft, has at his disposal a transcription of all the audio communications carried out (both incoming and outgoing). He is thus able to access (by reading the screen 17) each message which is communicated at the present instant (or which was communicated previously) by voice. This allows him in particular to read a message that he did not properly understand verbally, whatever the reason (imperfect understanding of English, accent difficult to understand or sound transmission problem) or that he would simply like to read again. This reading is facilitated by adjoining the source (ATC, P1, P2, etc.) to the textual message displayed.

The transcription and the display in accordance with the invention also allow pilots, during a critical situation, in particular when several tasks have to be carried out in parallel, to implement first the tasks that they judge to be of priority, paying lesser attention to the information communicated by radio (if the latter information is not judged to be of priority), and then to take cognizance (and to process) this non-priority information only subsequently.

Furthermore, said device 1 also comprises standard means for determining the emission time (expressed preferably in hours, minutes and seconds) of each audio message. Moreover, said display means 15 also display, on said screen 17, jointly with the textual message M1, M2, M3, M4 with which it is associated, the corresponding emission time T1, T2, T3, T4, as represented in FIG. 2.

Moreover, in a preferred embodiment, the device 1 in accordance with the invention comprises moreover:

playback means which comprise preferably said means 11, which are for example connected to the loudspeaker 3 (or comprise a dedicated loudspeaker), and which are able to carry out audio playback of any audio message recorded by the means 11; and activation means 19 which are able to be controlled by an operator so as to identify and trigger the playback by the playback means of a recorded audio message.

This preferred embodiment allows the user of the device 1 to listen to a message again instead of (or in addition to) reading it.

In a particular variant embodiment, said activation means 19 comprise:

for each textual message displayed on the screen 17, an associated sensitive area Z1, Z2, Z3, Z4 which is displayed jointly with the textual message M1, M2, M3, M4 with which it is associated, and which is able to be activated so as to trigger the playback of the audio message corresponding to said textual message; and means 20, for example a computer mouse or a trackball or any other standard means, which are connected by a link 21 to the means 15, and which allow an operator to bring a cursor to an area Z1, Z2, Z3, Z4 to be activated in order to designate it and activate it.

By way of illustration, the activation of the area Z4 by the means 19 thus triggers the audio playback (by the playback means) of the message M4 which was communicated at an instant T4 by an ATC air traffic controller.

FIG. 2 therefore shows an exemplary display able to be carried out on the screen 17, which indicates for each message (M1, M2, M3, M4) of a list M of messages:

the list S of corresponding sources: ATC, P1, P2, ATC;

the list T of corresponding emission times: T1, T2, T3, T4; and the list Z of corresponding activation areas: Z1, Z2, Z3, Z4.

Each list is presented column-wise, and the information for one and the same message is therefore displayed on a line.

Furthermore, in the case of a communication device 1 onboard an aircraft, said device 1 also comprises means, for example the means 20, which allow a pilot to copy at least part of a displayed textual message, and in particular the value of a flight parameter, and to transmit it to a user system (not represented) of the aircraft, such as a computer for example, thus avoiding the need for the pilot in the case of a flight parameter to enter its value, thereby reducing the workload as well as the risks of error.

Moreover, in a particular embodiment, the communication device 1 also comprises means, in particular the means 4, which make it possible to access an automatic terminal information service, of ATIS type ("Automatic Terminal Information Service"), which emits in a standard looped manner information about an airport (problem of congestion, state of runway, etc.). In this case, the transcription means 13 transcribe into textual messages all the audio messages emitted (in a loop) by this service and received and recorded by the device 1, and the display means 15 display these textual messages on the screen 17.

In a preferred embodiment, said display means 15 comprise a dedicated single graphical interface corresponding to the screen 17. This graphical interface can comprise a display page 27, such as represented by way of illustration in FIG. 3.

Figure 3:
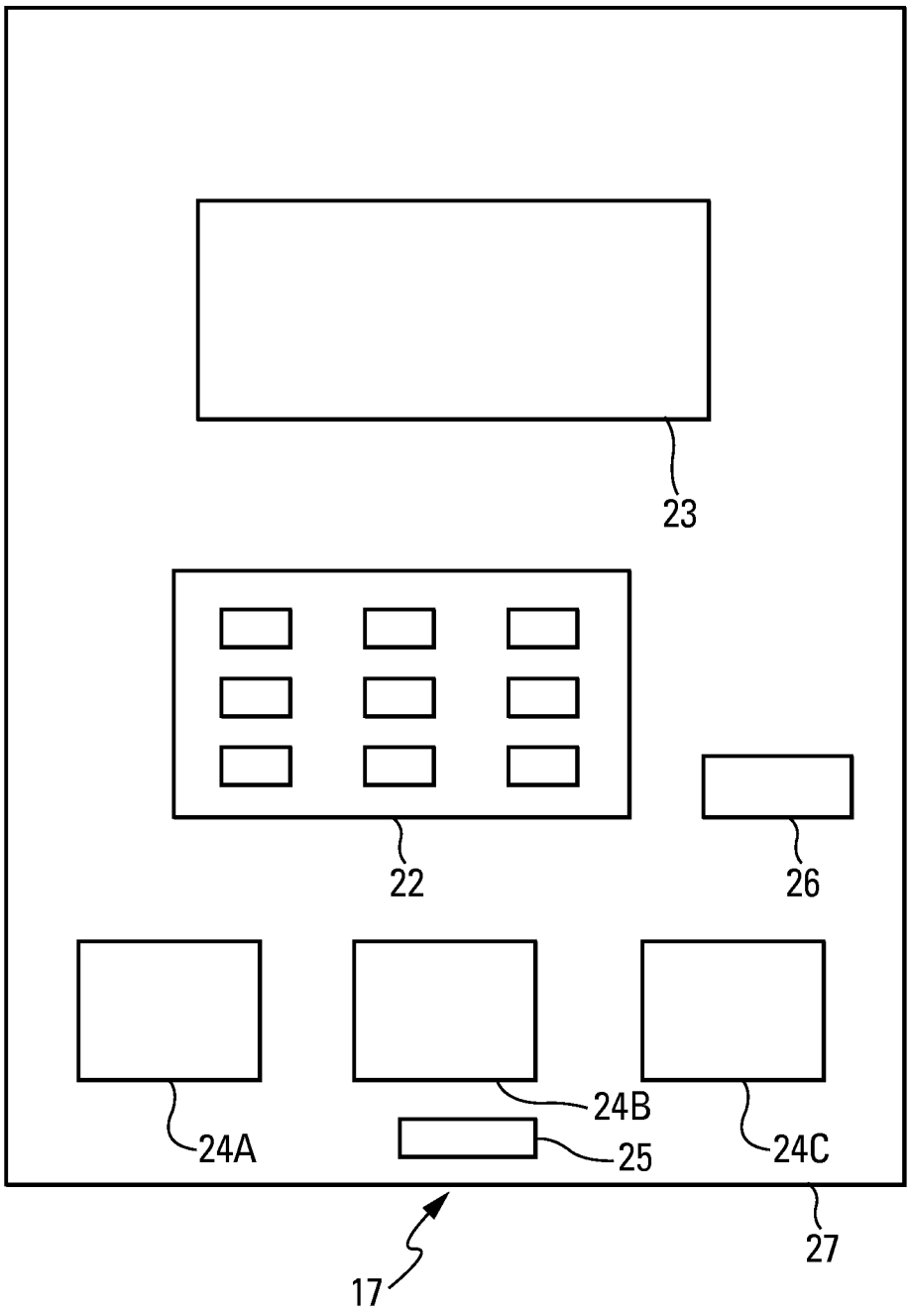
FIG. 3 schematically shows another exemplary display illustrating the invention.

This graphical interface makes it possible in particular to implement the following functions:

presentation of numerical values in table form, as illustrated schematically by a window 22 in FIG. 3;

distinct display of the textual message in progress, for example in a window 23;

separate display in dedicated windows 24A, 24B and 24C of a number N of latest messages received. Each of the windows 24A, 24B and 24C displays a single message, N being for example equal to 3; and presentation of a graphical element 25 able to display a pop-up list making it possible to recall previously transcribed messages, in addition to the last three, and their display in a particular window, for example in one of the windows 24A to 24C.

Said communication device 1 also comprises means 28 which form for example part of the assembly 18, as represented in FIG. 1, and which are formed so as to extract (by means of a computer program) particular data specified hereinbelow from an audio message or from a textual message.

In a first variant embodiment, said means 28 are configured to be able to extract, from each audio or textual message, certain values with the aim of providing them to computation means (not represented and integrated for example into the assembly 18) so as to compute particular parameters. By way of illustration may be cited an extraction (from an audio or textual message) of the values of the direction and of the speed of the wind at the landing runway, so as to compute the transverse component of the wind ("crosswind"), by multiplying the speed of the wind by the sine of the angle between the wind and the direction of the runway.

In a second variant embodiment (as a supplement or otherwise of said first variant), said means 28 (or other appropriate means) are configured to be able to extract, from each audio or textual message, numerical values and transmit them to the display device 15 so that it presents them on the screen 17 in the form of a table in accordance with a standard display, for example on the table of the window 22 of FIG. 3.

Furthermore, in a third variant embodiment (as a supplement or otherwise of said first and/or second aforementioned variants), said means 28 (or other appropriate means) are configured to be able to extract, from each audio or textual message, specific information for the pilots and transmit it to the display device 15 so that it presents it on the screen 17 in a dedicated field 26, for example a field of NOTAM type (for "Note to Airmen").

Moreover, said communication device 1 also comprises means 29 which form for example part of the assembly 18, as represented in FIG. 1, and which are formed so as to inter-compare at least two messages arising from one and the same source, for example from the ATC air traffic control, respectively at different moments, and to transmit to the display device 15 the differences, if any, between these two messages, so that it highlights them on the screen 17, for example on the textual messages displayed in the windows 24B and 24C of FIG. 3 if dealing with comparing the last two messages received by the device 1.

Said communication device 1 comprises, moreover, a voice recognition unit 30 (comprising a microphone 31 and software 32 connected together), as represented in FIG. 1. This voice recognition unit 30 receives a voice message from a user via the microphone 31 and it recognizes the word or the expression spoken into the microphone 31, and then retrieves it in a particular textual message, in particular the last message received. By way of illustration, the pilot can speak the following information request message into the microphone 31: "what is the temperature?" or "I wish to know the temperature", and the voice recognition unit 30 searches the corresponding text for the word "temperature" and highlights it. The pilot can then see this term on the textual message displayed and easily retrieve the numerical value directly associated with this term (and which often comes just after this term in the text).

The microphone of the voice recognition unit 30 can be a microphone 31 specially dedicated to voice recognition or said microphone 2 of the device 1 which is then connected by appropriate links (not represented) to said means 32.

Moreover, said voice recognition unit 30 comprises a standard voice training unit 34 which allows said unit 30 to train for new voices. This functionality guarantees a reliability of generally more than 98% for the voice recognition functionality.

Within the framework of the present invention, said device 1 can:

a) be mounted as a permanent fixture on an aircraft and therefore represent an avionics device; or
b) be integrated, at least in part, into a means of open world type which is able to be connected to at least one system of an aircraft; or else
c) be installed on the ground in an air traffic control post in particular.

In embodiment b), a part of the device 1 can be installed in a laptop computer (for example of "Electronic Flight Bag" type) or an electronic tablet used by a pilot and which comprises in particular standard instructions. In this case, the means 11, 13, 15 and 20 in particular of FIG. 1 are for example integrated into this computer or this tablet, whereas the means 2, 3 and 4 form part of a standard communication unit of the aircraft. Moreover, said computer is able to be connected to this communication unit, and in particular to the helmet of a pilot comprising the means 2 and 3 (via the links 10 and 12).

Within the framework of the present invention, it is also conceivable for the apportionment of the means of the device 1 between the laptop computer (or the tablet) and the avionics to be different, the computer integrating for example just the transcription means 13.

Consequently, when it is envisaged on an aircraft, in particular on a transport airplane, said device 1 can be integrated into an avionics system or form part of an open world system.

A communication device 1 in accordance with the invention such as described previously can form part of a communication system 35 which comprises a plurality of communication units U1, U2, U3 which are able to communicate with one another by way of radio waves OR, as represented in FIG. 4.

Within the framework of the present invention, at least one of the units of the system 35 is a device 1 in accordance with the invention. Of course, this may be the case for all the units of the system 35.

In the example represented in FIG. 4:

the unit U1 which is, for example, mounted on a first aircraft is a device 1;
the unit U2 which is, for example, installed on the ground in an air traffic control post, is also a device 1; and
the unit U3 which is, for example, mounted on a second aircraft, corresponds to a standard unit comprising for example just the means 2, 3 and 4 of FIG. 1.

The system 35 of FIG. 4 therefore comprises devices 1 in accordance with the invention and standard units U3. This shows the capabilities for integration of a device 1 in accordance with the invention which is able to communicate either with another device 1, or with a standard communication unit.

The invention claimed is:

1. A device for aiding communication in the aeronautical domain, said device comprising:

at least one microphone in an aircraft;
at least one loudspeaker in the aircraft;
a display screen in the aircraft, and
a transceiver and data processor assembly in the aircraft and configured to process and transmit data relating to audio communications to and from the aircraft, which is connected to said microphone and to said loudspeaker and which is configured to emit outgoing audio communications and to receive incoming audio communications, wherein the transceiver and data processor assembly is configured to:
record audio messages corresponding to the incoming and outgoing audio communications;
transcribe, in real time, said audio messages into textual messages;
display, on the display screen, the textual messages in a table, each textual message being displayed associated with an indicator indicating a source of the textual message and an emission time of its corresponding audio message, wherein the table includes a first array of cells each for a source of each of the textual messages, a second array of cells each for at least a portion of each of the textual messages, and a third array of cells each for an emission time of each of the audio messages;
extract data associated with a predetermined flight parameter from at least one of the audio or textual messages, and display a value representative of or derived from the extracted data on the display screen in a region of the display screen separate from a region displaying the textual message.

2. The device as claimed in claim 1, wherein the transceiver and data processor assembly is further configured to:

selectively playback audio of any of the recorded audio messages; and be activated by an operator to identify and trigger the playback of a selected one of the recorded audio messages, wherein the trigger of the playback is actuated by the operator selecting a portion of the display screen at or adjacent the textual message corresponding to the selected one of the recorded audio messages.

3. A device for aiding communication in the aeronautical domain, said device comprising:

at least one microphone in an aircraft;

at least one loudspeaker in the aircraft;

a display screen in the aircraft, and a transceiver and data processor assembly in the aircraft and configured to process and transmit data relating to audio communications to and from the aircraft, which is connected to said microphone and to said loudspeaker and which is configured to emit outgoing audio communications and to receive incoming audio communications, wherein the transceiver and data processor assembly is configured to:

record audio messages corresponding to the incoming and outgoing audio communications;

transcribe, in real time, said audio messages into textual messages;

extract data associated with a predetermined flight parameter from at least one of the audio or textual messages;

display the textual messages on the display screen in a table in an order in which corresponding audio messages are emitted and in conjunction with a selectable area of the display screen, wherein the selectable area is configured to trigger playback of the recorded audio message corresponding to said textual message in response to actuation of the selectable area by an operator and the table includes a first array of cells each for a source of each of the textual messages, a second array of cells each for at least a portion of each of the textual messages, and a third array of cells each for an emission time of each of the audio messages, and display the extracted data on a region of the display screen separate from the display of the text messages and the associated selectable area.

4. The device as claimed in claim 1, wherein the transceiver and data processor assembly is further configured to accept an input command to copy at least part of a displayed textual message and transmit the copied textual message.

5. The device as claimed in claim 1, wherein the transceiver and data processor assembly is further configured to determine a time of emission of each audio message, and display the time of emission with the textual message associated with the audio message.

6. The device as claimed in claim 1, wherein the transceiver and data processor assembly is further configured to automatically transcribe into textual messages all the audio messages and display said textual messages on said screen.

7. The device as claimed in claim 1, wherein said display screen is included in a dedicated single graphical interface.

8. The device as claimed in claim 1, wherein the transceiver and data processor assembly is further configured to compare at least two textual messages the same source at different moments, and highlight differences between the two textual messages.

9. The device as claimed in claim 1, wherein the transceiver and data processor assembly is further configured to receive a voice request for information, to search for and find a textual message responsive to the requested information, and display the found textual message on the screen.

10. The device as claimed in claim 9, wherein the transceiver and data processor assembly is further configured to include a voice training unit.

11. The device as claimed in claim 1, which is mounted as a permanent fixture on the aircraft.

12. The device as claimed in claim 1, which is connected to at least one system of the aircraft.

13. A communication device for aiding the piloting of an aircraft comprising:

a transceiver on the aircraft and configured to receive and transmit voice messages between the aircraft and at least one air traffic control official or between the air traffic control and another aircraft;

a computer on the aircraft and including a non-transitory storage system storing instructions which, when executed by the computer cause the device to:

transcribe, in real time, each of the incoming and/or outgoing voice messages between the aircraft and the air traffic control official or between the air traffic control and the another aircraft;

record each of the voice messages;

display in the form of a table, on a touch sensitive display screen in an flight deck of the aircraft, the transcription of each of the voice messages associated with an indicator indicating a source of the voice message and an emission time of the voice message, wherein the table includes a first array of cells each for an indicator indicating a source of each of the textual messages, a second array of cells each for at least a portion of the transcription of each of the voice messages, and a third array of cells each for an emission time of each of the audio messages;

playback audibly one of the recorded voice messages which corresponds to a portion of the transcription adjacent a region of the display screen touched by an operator;

recognize a numeric value and an associated flight parameter in the transcribed voice message, and display, on the display screen in a second region separate from the display of the transcription of each of the voice messages, a value representative or derived from the numeric value adjacent a display of an indicia of a flight parameter.

14. The communication device of claim 13 wherein the flight parameter is a crosswind at a landing runway, and the recognized numeric value and the associated flight parameter include a numeric values representative of wind direction and wind speed, and the device further calculates the crosswind based on the wind direction and wind speed, and the calculated cross wind is the displayed value.

15. A system configured to display text information indicative of recent speech communications transmitted or received by flight crew operating an aircraft, the system comprising:

a display screen including a message region of the screen configured to display the text information indicative of the speech communications, wherein the message region displays, for each recent speech communication, an alphanumeric information indicating a source of the speech communication, text representative of a transcription of at least a portion of the speech communication, and a time indicator indicative of a time of the speech communication;

a transceiver configured to transmit and receive the speech communications wherein the speech communications include speech communications between the flight crew and an air traffic controller and between the other aircraft and the air traffic controller; and at least one processor configured to:

transcribe, detect the source of, and determine the time of the speech communication, for each of the speech communications;

generate, for each of the speech communications, the text representative of the transcription of at least some of the speech communications, the alphanumeric information, and the time indicator to be displayed on the message region, provide the display screen, for each of the speech communications, with the text, the alphanumeric information, and the time indicator of the speech communication, and extract from at least some of the speech communications or the transcribed text representative of the transcription of at least some of the speech communications, certain data representing a flight parameter of one of the other aircraft and generate an alphanumeric representation of that data which is displayed on another region of the display screen, wherein said another region is separate from the message region, wherein the at least one processor causes the message region of the display screen to display a table listing the recent speech communications, and the table includes a first array of cells each for the alphanumeric information indicating the source of each of the recent speech communications, a second array of cells each for the text representative of the transcription of at least a portion of each of the speech communications, and a third array of cells each for the time indicators indicative of the time of each of the speech communications.

16. The system of claim 15 wherein the at least one processor stores an audio of each of the speech communications and wherein the message region displays a selectable area adjacent the alphanumeric information for each of the recent speech communications, and the selectable area, when selected by the flight crew, causes the processor and a sound system to replay the stored audio of the speech communication associated with the alphanumeric information.

17. A system configured to display text information indicative of recent speech communications transmitted or received by flight crew operating an aircraft, the system comprising:

a display screen including a message region of the screen configured to display the text information indicative of the speech communications, wherein the message region displays, for each recent speech communication, an alphanumeric information indicating a source of the speech communication, text representative of a transcription of at least a portion of the speech communication, and a time indicator indicative of a time of the speech communication;

a transceiver configured to transmit and receive the speech communications wherein the speech communications include speech communications between the flight crew and an air traffic controller and between the other aircraft and the air traffic controller; and at least one processor configured to:

transcribe, detect the source of, and determine the time of the speech communication, for each of the speech communications;

generate, for each of the speech communications, the text representative of the transcription of at least some of the speech communications, the alphanumeric information, and the time indicator to be displayed on the message region, provide the display screen, for each of the speech communications, with the text, the alphanumeric information, and the time indicator of the speech communication, and extract from at least some of the speech communications or the transcribed text representative of the transcription of at least some of the speech communications, certain data representing a flight parameter of one of the other aircraft and generate an alphanumeric representation of that data which is displayed on another region of the display screen, wherein said another region is separate from the message region, wherein the at least one processor causes the message region of the display screen to display a table listing the recent speech communications, and the table includes a first column for the alphanumeric information indicating the source of each of the recent speech communications, a second column for the text representative of the transcription of at least a portion of the speech communications, and a third column for the time indicators indicative of the time of each of the speech communications.

18. A method of displaying text information indicative of recent speech communications transmitted or received by flight crew operating an aircraft, comprising:

for each of the speech communications, transcribing, detecting a source of and determine a time of the speech communication;

generating, for each of the speech communications, a text representative of a transcription of at least a portion of the speech communication, an alphanumeric information indicating the source of the speech communication, and a time indicator indicative of the time of the speech communication, to be displayed on a message region;

providing the display screen, for each of the speech communications, with the text representative of the transcription, the alphanumeric information, and the time indicator;

displaying on the message region of a display screen, for each recent speech communication, the alphanumeric information, the text representative of the transcription, and the time indicator; and extracting from at least some of the speech communications or the text representative of the transcription, certain data representing a flight parameter of one of the other aircraft and generating an alphanumeric representation of that data which is displayed on another region of the display screen, wherein said another region is separate from the message region, and wherein the message region of the display screen displays a table listing the recent speech communications, and the table includes a first array of cells each for the alphanumeric information indicating the source of each of the recent speech communications, a second array of cells each for the text representative of the transcription of at least a portion of the speech communications, and a third array of cells each for the time indicators indicative of the time of each of the speech communications.

* * * * *